United States Patent [19]

Andersen

[11] 4,298,854

[45] Nov. 3, 1981

[54] COMBINED SWITCH AND FUSE HOLDER

[76] Inventor: James H. Andersen, 8045 E. Mercer Way, Mercer Island, Wash. 98040

[21] Appl. No.: 158,936

[22] Filed: Jun. 12, 1980

[51] Int. Cl.[3] ..... H01H 85/22

[52] U.S. Cl. ..... 337/10; 337/149; 337/214

[58] Field of Search ..... 337/2, 4, 8, 10, 11, 337/149, 213–215, 237; 200/153 G

[56] References Cited

U.S. PATENT DOCUMENTS

| | | | |
|---|---|---|---|
| 1,620,814 | 3/1927 | Getchell | 337/10 |
| 3,354,277 | 11/1967 | Stanback et al. | 337/8 |
| 3,800,259 | 3/1974 | Humphreys | 337/10 |

*Primary Examiner*—William H. Beha, Jr.
*Attorney, Agent, or Firm*—Christensen, O'Connor, Johnson & Kindness

[57] ABSTRACT

A combined cartridge fuse holder and switch employs a novel switching mechanism including a pair of spaced bars arranged in a first plane and positioned adjacent an inclined ramp. A contact pin is mounted in a switch arm, which in turn is pivotally mounted so that the pin can be moved from an OFF position in which the pin rests on the inclined ramp to an ON position resting on and bridging the contact bars. One of the contact bars is electrically coupled to a first terminal while the other of the contact bars is electrically coupled through a fuse to a second terminal.

14 Claims, 10 Drawing Figures

COMBINED SWITCH AND FUSE HOLDER

BACKGROUND OF THE INVENTION

The present invention relates generally to electrical switches, more particularly to a combination fuser holder and switch, and in its preferred form, a combination cartridge fuse holder and switch mechanism of the type that can be panel mounted and which can be manufactured for mounting from the front or rear of the panel.

Cartridge fuses are normally employed in many electrical circuits, especially those employed in automobiles, boats, and other low-voltage applications. Cartridge fuses are also utilized in normal house current circuits for protection of electrical components such as those employed in radios and televisions. Normally, cartridge fuses of the type having a glass tube housing a fuse link with ferrule contacts at each end are mounted in separate fuse holders and are coupled in series with an electrical circuit to be protected. In many applications, such as in automobiles and boats, a separate fuse panel centralizes the location of the fuses for the several circuits employed. Commonly, such fuse panels are tucked into niches that are often, at the very least, difficult to access. Moreover, costly wiring is required to form electrical circuits between the switches and the fuse panel. Furthermore, because of the limited space, the labelling of the various fuses is cryptic and sometimes nonexistent, thus making it difficult to locate a given fuse that is coupled to a particular circuit. Additionally, a separate fuse panel takes up space that might otherwise be put to a more valuable use.

It is therfore a broad object of the present invention to provide a fuse holder that is easily accessible and is easily identified with a given circuit. It is a further object of the present invention to combine the functions of a fuse holder and a switch so that the prior fuse panels can be eliminated. It is an important object of the present invention to provide a switch and fuse holder that occupies as little space and eliminates expensive switch-to-fuse panel wiring. Further objects of the present invention are to provide a combined cartridge fuse holder and switch that is relatively inexpensive to manufacture, that is relatively easy to install and connect into a circuit, that places the cartridge fuse in a position for easy accessibility, and that is foolproof in operation and virtually indestructible.

SUMMARY OF THE INVENTION

Accordingly, the foregoing objects and other objects that will become apparent to one of ordinary skill in the art, are achieved by the present invention which provides a combination switch holder and fuse comprising a body means, a pair of bar contacts, a switch pin, a pair of terminals, and means for moving the contact pin into and out of bridging relationship with the contact bars. One of the contact bars is coupled to a first terminal. The second contact bar is placed in series connection with a fuse and the second terminal. The contact bars are positioned in appropriate receptacles in the body means so that their upper edges are located in spaced relationship and lie substantially in a common plane. The body means includes a ramp-like structure intersecting the common plane in which the upper edges of the contact bars lie. The contact pin is swung from the ramp onto bridging contact with the contact bars to complete a circuit from the first to the second terminal.

When the switch pin is swung from the contact bars to the adjoining ramp, bridging contact with the contact bars is lost, thus breaking the circuit between the terminals.

BRIEF DESCRIPTION OF THE DRAWINGS

A better understanding of the present invention can be derived by reading the ensuing specification in conjunction with the accompanying drawings wherein.

DETAILED DESCRIPTION OF THE INVENTION

Figures 1, 6, 7:
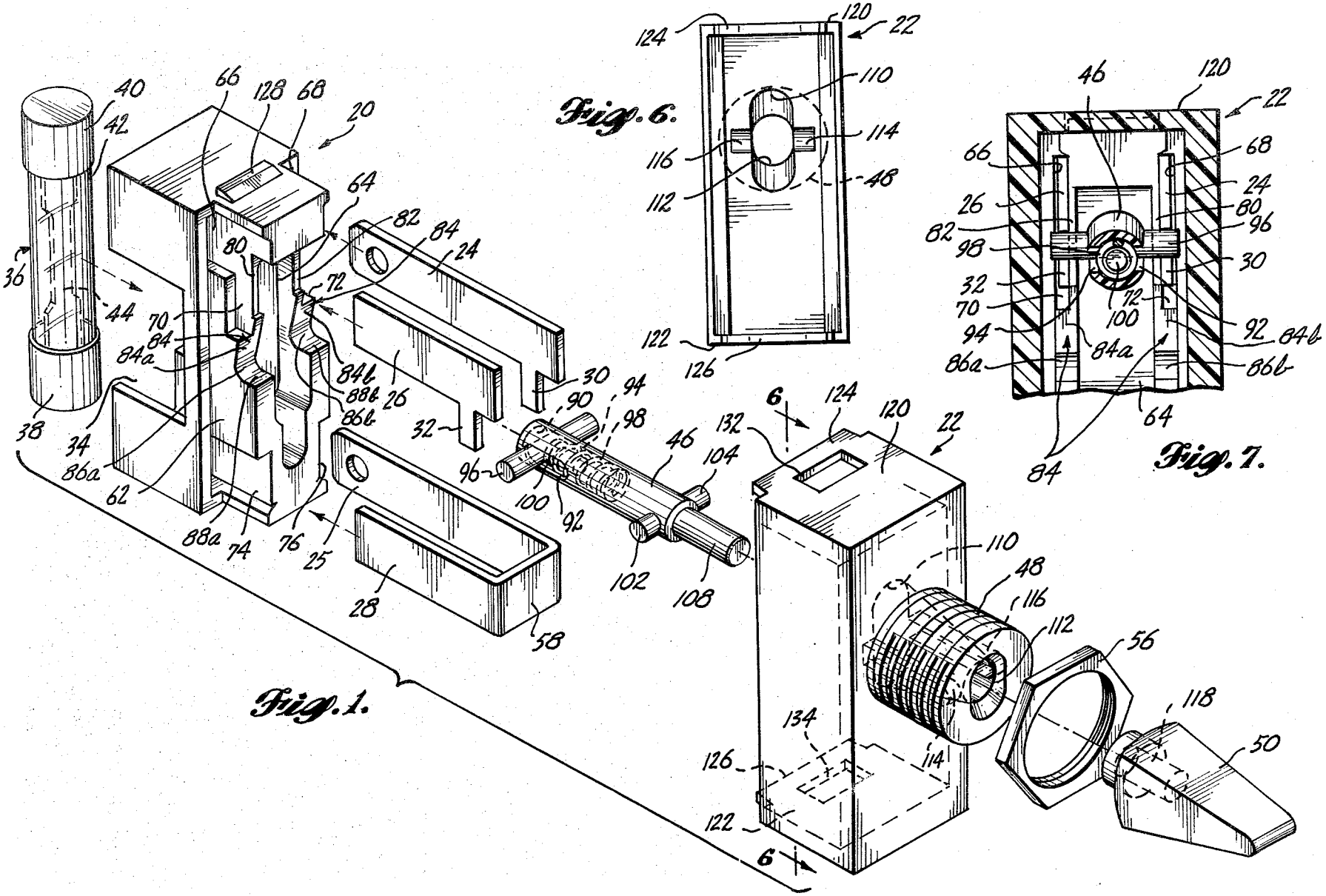
FIG. 1 is an exploded isometric view of a first embodiment of the combined fuse holder and switch of the present invention showing a toggle switch configuration.
FIG. 6 is a view taken along view line 6—6 of FIG. 1.
FIG. 7 is a view in partial cross section taken along section line 7—7 of FIG. 4.
Figure 2:
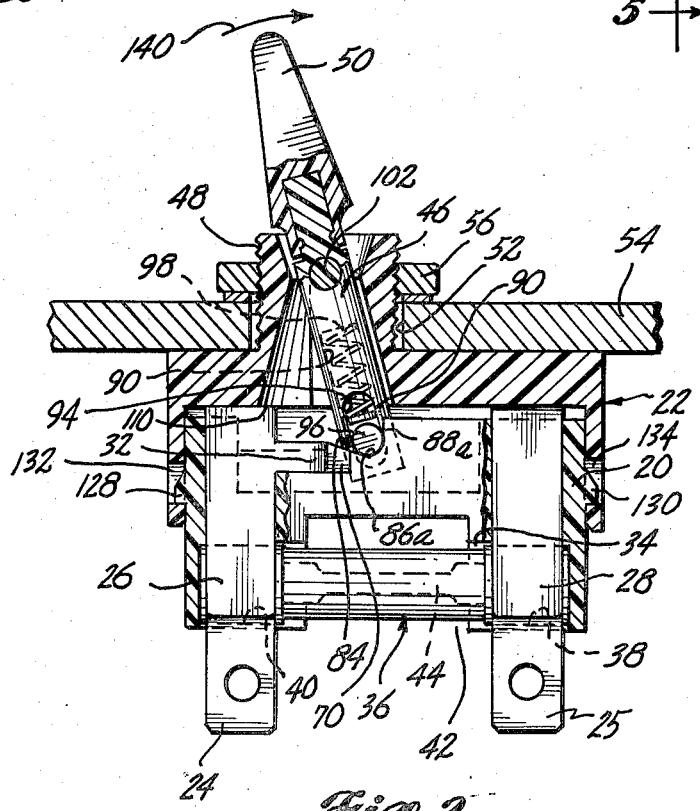
FIG. 2 is a longitudinal sectional view of the assembled switch shown in the OFF position.

Referring first to FIGS. 1 and 2 conjunctively, the switch housing is divided into two portions, a lower body 20 and an upper switch holder 22. The body 20, as will be described in more detail below, carries two terminals 24 and 25, fuse contacts 26 and 28, as well as contact bars 30 nd 32, which are integrally formed respectively with terminal 24 and fuse contact 26. The bottom portion of the body 20 defines a receptacle 34 for receiving a cartridge-type fuse 36. The cartridge fuse 36 is of conventional design, including upper and lower ferrule contacts 38 and 40 affixed to a glass tube 42 housing a conventional fuse link 44.

The switch holder 22 carries a pivotally mounted switch arm 46 which extends through a tubular projection 48 on the upper side thereof. A switch handle 50 is affixed to the upper end of the switch arm 46. The tubular projection 48 is threaded so that it can be inserted through an appropriately sized aperture 52 in a switch panel 54 and retained thereon by a threaded retainer nut 56 (FIG. 2).

Still referring to FIGS. 1 and 2, the exterior of the body 20 is configured generally in the shape of a right rectanguar polyhedron having longitudinal and lateral dimensions. The upper portion of the body 20 is specially configured to receive the remaining components of the switch, including the terminals 24 and 25, the fuse contacts 26 and 28, contact bars 30 and 32. Additionally, the switch holder fastens to the upper portion of the body 20 so that the lower end of the switch arm 46 is appropriately positioned relative to the upper portion of the body 20.

Terminal 24 and contact bar 30 are integrally formed. The contact bar 30 has a smaller longitudinal and lateral dimension that does the terminal 24. The contact bar 30 is positioned adjacent the upper end of the terminal bar 24 and extends orthogonally and laterally from one of the side edges of the terminal bar 24. Similarly, the contact bar 32 is integrally formed with fuse contact 26. Contact bar 32 is sized similarly to bar 30, is positioned adjacent the upper end of fuse contact 26, and extends orthogonally and laterally relative to fuse contact 26. The lateral and longitudinal dimensions of contact bar 32 are relatively smaller than those of the fuse contact 26 while the lateral dimension of the fuse contact 26 is similar to the lateral dimension of the terminal bar 24. The fuse contact 26 is, however, slightly shorter than the terminal bar 24. Terminal bar 25 is integrally formed with fuse contact 28 by a web 58 that joins the upper ends of the members.

The central upper portion of the body 20 has a generally rectangularly shaped upward projection 62 that has a longitudinal extent equal to the longitudinal extent of the body 20. The lateral extent of the upward projection 62 is, however, somewhat less than the lateral extent of the body 20. The central portion of the upward projection 62 carries an elongated slot 64 that extends downwardly into the projection 62 in a direction generally parallel with the longitudinal extent of the projection. As will be seen later, this slot receives the bottom end of the switch arm 46 and allows the switch arm to swing freely about its pivot axis. Vertical slots 66 and 68 are formed in the sides of the projection 62 adjacent one end thereof. Slot 66 extends along the vertical sides of the projection 62 and downwardly through the body 20 to communicate with one end of the fuse receptacle 34. Slot 66 is sized to receive the fuse contact 26. A recess 70 is also formed in the side of the projection 62 and communicates with the upper end of the slot 66 for receiving contact bar 32 when the fuse contact 26 is inserted into slot 66. Similarly, slot 68 is formed in the side of projection 62 adjacent the same end in which slot 66 is located, but on the opposite side of the projection 62. Slot 68 extends vertically from the upper end of the projection 62 and downwardly through the body 20. Slot 68 is sized to receive the terminal bar 24. Similarly, a recess 72 extending longitudinally along the side of the projection 62 communicates with the upper end of slot 68 and is sized to receive the contact bar 30 when the terminal bar 24 is inserted into the slot 68. The terminal bar 24 has a sufficient length so that the bottom of the terminal extends downwardly beyond the bottom surface of the body 20.

A similar pair of slots 74 and 76 are formed along the sides of the opposite end of the projection 62. Slot 74 is sized to receive the fuse contact 28 and extends vertically from the upper portion of the projection 62 downwardly through the body and communicates with the fuse receptacle 34. Slot 76 is on the opposite side of the projection 62 from slot 74 and extends vertically from the upper end of the projection 62 downwardly through the body and exits from the bottom surface of the body 20. Slot 76 is sized to receive terminal bar 25. Terminal bar 25 has sufficient length so that when in place the bottom end thereof projects beyond the bottom surface of the body 20. Of course, the length of the web 58 is such that both the fuse contact 28 and the terminal bar 25 can extend in parallel relationship downwardly through the respective slots 74 and 76. Although in the preferred embodiment all of the slots are oriented so that the fuse contacts 26 and 28 and the terminal bars 24 and 25 are oriented in parallel relationship, they need not be so constructed.

The recesses 70 and 72 into which the contact bars 32 and 30, respectively fit are so positioned that the upper edges of the contact bars 30 and 32 lie in a common plane. Small elongated recesses 80 and 82 are formed in the upper surfaces of the projection 62 lying between the contact bars 30 and 32 and the slot 64. These recesses 80 and 82 are provided so that variations in the width of contact bars 30 and 32 and their location on the terminal bar 24 and fuse contact 26 will never allow the upper edges of the contact bars 30 and 32 to lie below the upper surface of the projection 62, the import of which will clearly be seen below. An inclined ramp 84 is formed by two inclined surfaces **84*a* and 84*b* positioned on each side of the slot 64. The ramp 84 extends downwardly from the upper exposed edge of the contact bars 30 and 32 and terminates in rounded depressions 86*a* and 86*b* followed by vertical walls 88*a* and 88*b*. The upper end of the ramp 84 intersects with the plane formed by the upper edges of the contact bars 30 and 32 when in place at a line of intersection joining the upper exposed corners of the contact bars 30 and 32. Preferably, the plane formed by the upper edges of the contact bars 30 and 32** and the ramp diverge relatively downwardly from that line of intersection.

Still referring to FIGS. 1 and 2, the switch arm 46 carries an internal bore 90 that extends upwardly into the arm 46 in concentric relationship from the bottom of the arm. A pair of longitudinal slots 92 and 94 extend from adjacent the bottom of the arm 46 upwardly along a portion of the length of the bore 90. A contact pin 96 is oriented orthogonally to the switch arm 46 and is inserted through the slots 92 and 94 so that it can move laterally in the slots relative to its own axis and longitudinally relative to the axis of the switch arm 46. A compression spring 98 is positioned in the bore and a self-lubricating washer 100 is positioned on the bottom of the compression spring 98. The compression spring bears on the washer 100, which in turn bears on the pin 96 to bias it in a downward direction toward the bottom of the slots 92 and 94.

The upper portion of the switch arm 46 carries a pair of orthogonal stub shafts 102 and 104 which serve as pivot members for the switch arm 46. A reduced diameter extension 108 of the switch arm 46 extends longitudinally upwardly from the upper end of the switch arm 46.

Referring to FIGS. 1, 2, and 6, the switch holder 22 and tubular projection 48 carry a downwardly flared slot 110 which receives the upper end of the switch arm 46 and the extension 108. The flared slot 110 terminates in an opening 112 on the upper surface of the tubular projection 48. A pair of inwardly opening, parallel slots 114 and 116 extend upwardly from the bottom of the tubular projection 48 and terminate below the upper surface of the tubular projection 48. The slots 114 and 116 are sized to receive the stub shafts 102 and 104. As will be seen later, the stub shafts 102 and 104 are held in the upper portions of the slots 114 and 116 by the force exerted on the switch arm 46 by the biasing spring 98. The extension 108 extends through the opening 112 and receives a manipulable handle 50. The handle 50 has a bore 118 in the bottom side thereof of suitable size to form an interference fit with the extension 108 so that once the handle is positioned on the extension 108, it is securely attached.

The switch holder is otherwise formed generally in the shape of a right rectangular polyhedron having two sides, two ends, an upper wall from which the tubular projection 48 extends. The bottom of the switch holder 22 is open, thus, the switch holder when in place serves to form a housing for the upwardly extending projection 62 on the body 20 and the remaining components of the switch that are associated with the upwardly extending projection.

The longitudinal dimension of the switch holder 22 is slightly greater than the longitudinal dimension of the body 20 by the thickness of the holder end walls 120 and 122. The bottom sides of the end walls 120 and 122 carry downwardly projecting tabs 124 and 126, respectively. When the switch holder 22 is assembled on the top of the body 20, end walls 120 and 122 extend down along the end portions of the projection 62 on the body, while the tabs 124 and 126 extend down beyond the base of the projection along the ends of the main portion of the body 20. Retainer nibs 128 and 130 extend longitudinally outwardly from the ends of the body 20. Corresponding detent openings 132 and 134 formed in the tabs 124 and 126 are positioned so that when the bottom side edges of the holder 22 engage the upper edges of the main portion of the body 20, the retainer nibs 128 and 130 will engage the detents 132 and 134 in the tabs 124 and 126 to firmly secure the switch holder 22 to the body 20.

When the switch holder 22 is so assembled on the body 20 and the switch arm 46 is appropriately positioned, the contact pin 96 will reside in rounded depressions **86*a* and 86*b* at the bottom of the ramp 84, as illustrated in FIG. 2. The compression spring 98 will be slightly compressed so that a downward, biasing force is exerted on the pin 96, thus retaining the pin at the bottom of the ramp 84 and thus retaining the switch arm 46** in an OFF position.

Figure 3:
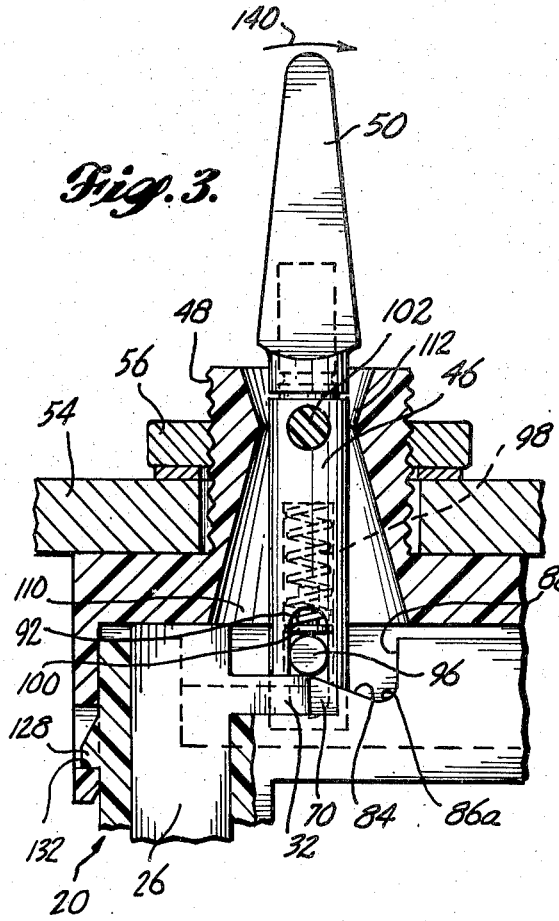
FIG. 3 is an enlarged view similar to FIG. 2 showing the switch in an intermediate position.
Figure 4:
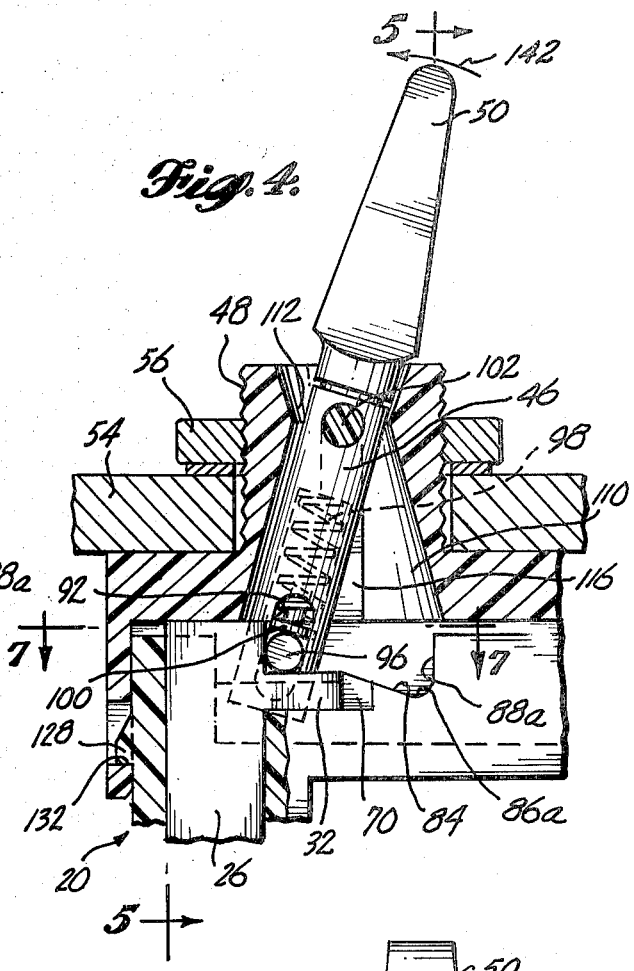
FIG. 4 is a view similar to FIG. 3 showing the switch in a full ON position.

Referring now to FIGS. 2 through 4, when a force is exerted on the handle 50 in the direction of arrow 140 (FIG. 2), the switch arm is pivoted about its pivot axis formed by stub shafts 102 and 104. The pivoting motion swings the bottom end of the switch arm 46 so that the contact pin 96 rolls up the ramp 84 and makes contact with the exposed upper edges of the contact bars 32 and 30. It will be noted that the slots 114 and 116, in which the stub shafts 102 and 104 are positioned, are so located that the switch arm 46 is resting in a nearly vertical position when the contact pin 96 is resting at the upper portion of the ramp and just making contact with the exposed corner of the upper edges of the contact bars 30 and 32. Also, as the pin rolls up the ramp 84, the compression spring 98 is further compressed. Thus, if the pivoting force being exerted on the handle were released when the contact pin 96 resides at the top of the ramp 84, the biasing force on the pin 96 would cause the entire switch arm 46 to swing in a counterclockwise direction so that the contact pin 96 once again resides at the bottom of ramp 84.

When the force in the direction of arrow 140 is continued to be applied once contact between the contact pin 96 and the upper edges of the contact bars 30 and 32, the bottom of the switch arm 46 will be swung in a clockwise direction so that the contact pin rolls along and bridges the upper edges of the contact bars 30 and 32 to make a complete circuit from the one terminal 24 through the fuse contacts 26 and 28 and to the other terminal. See FIG. 3. In its full ON position as shown in FIG. 4, the contact pin comes to rest against the vertical edges of the terminal bar 24 extending above contact 30 and of the fuse contact 26 extending above contact bar 32 as shown in FIGS. 4 and 7. In this position, electrical contact between the contact pin 96 and the terminal bar 24 and contact bar 32 and fuse contact 26 is made at two locations, thus doubly assuring adequate electrical contact when the switch is in the full ON position. Again, the stub shafts 102 and 104 are positioned such that when the contact pin 96 is in its full ON position, the compression spring 98 is once again biasing the contact pin 96 toward the upper edges of the contact bars 30 and 32 and the vertical edges of the terminal bar 24 and fuse contact 26 so as to bias the switch arm 46 toward and hold it in the full ON position. When it is desired to turn the switch off, force is applied to the handle 50 in the direction of arrow 142 to reverse the procedure just described. The contact bar receiving recesses 70 and 72 extend longitudinally beyond the ends of the contact bars 30 and 32, thus forming a small void in the ramp 84 immediately in front of the contact bars 30 and 32. This void prevents the tracking of contact residue down the ramp as could occur over prolonged periods of use. If contact residue were tracked down the ramp, electrical contact across the contact bars 30 and 32 could still be made even though the pin 96 was residing at the bottom of the ramp 84. The voids, however, prevent a complete circuit from being made by a trail of contact material down the ramp 84.

Figure 5:
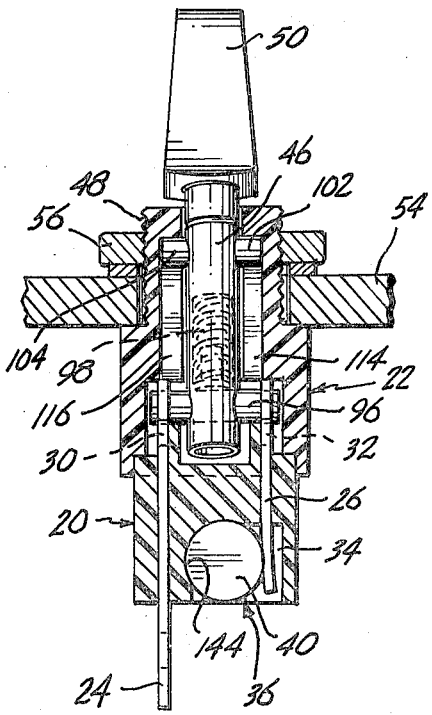
FIG. 5 is a cross-sectional view taken along staggered section line 5—5 of FIG. 4.

Referring now to FIGS. 1, 2, and 5, it will be noted that the lower end of the fuse contact 26 extends into the fuse receptacle 34. The bottom portion of the fuse contact 26 is positioned adjacent one side of the receptacle 34, but is positioned a slight distance away from that side. The opposite side of the receptacle 34 carries a rounded detent portion 144 having a curvature similar to that of the ferrule contact 40 of the fuse. When a fuse is inserted, the lower portion of the fuse contact 26 flexes sidewardly to allow insertion of the fuse. The lower portion of the fuse contact is sufficiently resilient so that it holds the ferrule contact 40 in the detent 144, thus retaining the fuse in the body 20 of the switch. The second fuse contact 28 located on the opposite end of the fuse receptacle 34 is similar in construction and function to fuse contact 26.

At this point, several advantages of the switch construction of the present invention should be noted. First of all, in the full ON position, four contact points between the contact pin 96 and the fuse contact bars 30 and 32 terminal 24 and fuse contact 26 are provided to assure good electrical contact in the ON position. Furthermore, the contact pin 96 is mounted in the switch arm 46 so that it rolls into and out of contact with the upper edges of the contact bars. Therefore, arcing is kept to a minimum. Additionally, the good cleaning action of the contact surfaces is maintained by the rolling contact pin. It is also important to note that when the switch arm is being moved to its OFF position, the contact pin 96 has reached an over-center position relative to the stub shafts 102 and 104 on the switch arm 46 and the ramp 84, thus the biasing force caused by spring 98 on the contact pin tends to drive the in down the ramp 84 providing "snap-over" action. This snap-over action minimizes arcing during the time the switch is being turned off. Additionally, the switch is positive acting. That is, even if a slight welding of the contact pin to the contact bars should occur, due to excessive arcing or an excessive load employed on the switch, a positive force can be applied to the contact pin to break the weld and force the pin either to a full ON or full OFF position. Contrariwise, many prior art switches do not provide such positive weld-breaking action and thus, can become permanently welded in the ON position, requiring replacement of the switch.

Figure 8:
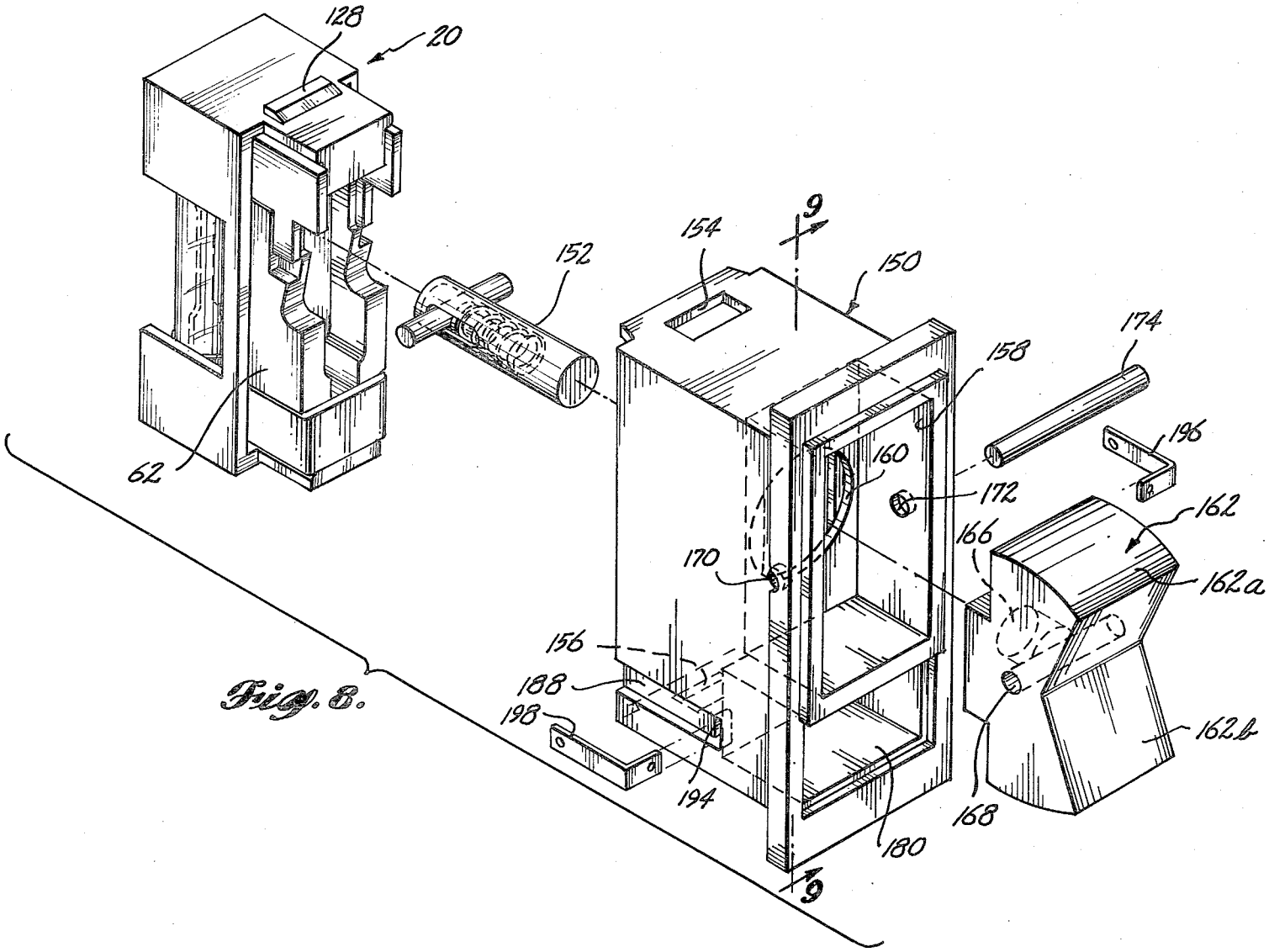
FIG. 8 is an exploded isometric view of a second embodiment of the combined fuse holder and switch of the present invention showing a rocker switch configuration.
Figure 9:
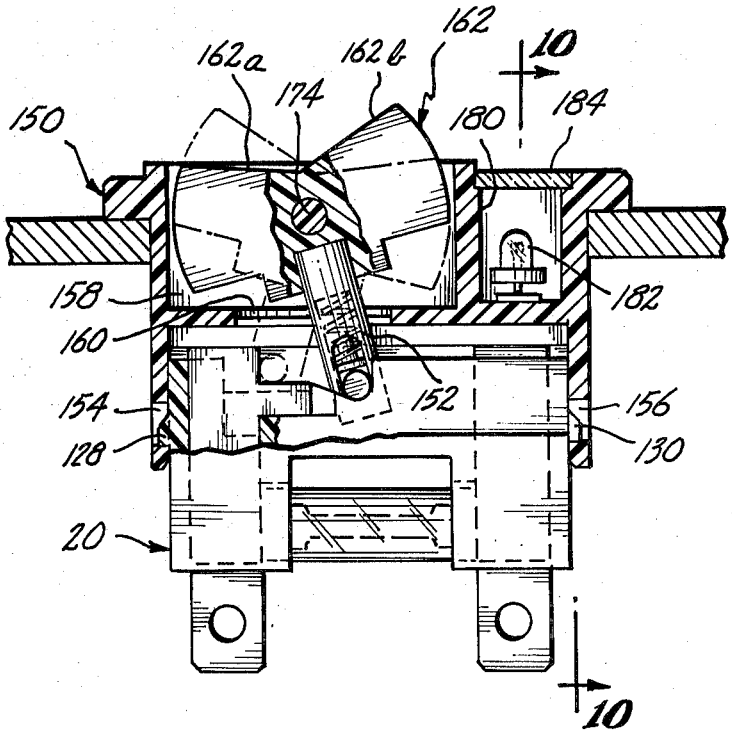
FIG. 9 is longitudinal sectional view through the assembled switch shown in FIG. 8.
Figure 10:
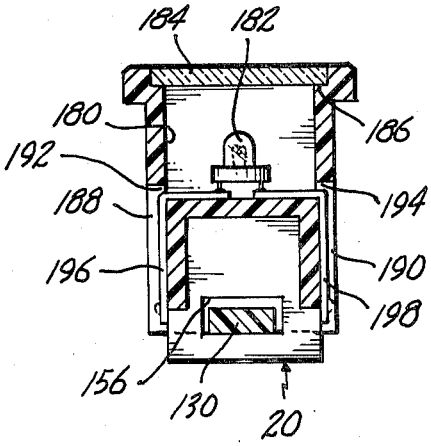
FIG. 10 is a view in partial cross section taken along staggered section line 10—10 of FIG. 9.

Referring now to FIGS. 8, 9, and 10, the second embodiment of the present invention employing a rocker-type switch arm actuator, as opposed to a toggle actuator, is disclosed. In addition, the switch of the second embodiment has two additional features not displayed by the first embodiment. The first feature is a separate indicator light built into a recess viewable from the front of a switch panel. Additionally, this embodiment of the switch, while employing the same lower portion of the body 20 as employed by the first embodiment, has an upper switch holder 150 that is so constructed as to allow insertion and removal of the entire switch assembly from the front of a panel in which it is mounted. Referring first to FIGS. 8 and 9, the body 20 as just stated is identical. In addition, the switch arm 152 is similar in construction to switch arm 46 with the exception that no stub shafts and no longitudinal extension are employed.

Switch holder 150 has a base portion that is formed generally in the shape of a rectangular polyhedron. The polyhedron has an upwardly extending, rectangular opening in the bottom thereof to house the upward projection 62 on the body 20 as well as the associated contacts, terminals, and switch components. Similar to the first switch holder, the rocker switch holder 150 has detent openings 154 and 156 in downwardly extending tabs for engaging the nibs 128 and 130 on the body 20 to fasten the rocker switch holder 150 to the body 20. The rocker switch holder 150 is somewhat deeper than the toggle switch holder 22 to provide for an upwardly opening rectangular recess 158. This recess is centered over the upper exposed edges of the contact bars 30 and 32 when the rocker switch holder 150 is in place on the body 20. The rectanglar recess 158 communicates with the remainder of the housing through a circular aperture 160.

A rocker switch member 162 has two arms, 162*a* and 162*b*, similar to a conventional rocker switch. The two arms have upper surfaces that are downwardly convergent and intersect each other at the center of the switch member 162. Extending downwardly from the center portion of the switch member 162 is a bore 166 sized to receive the upper end of switch arm 152 in an interference fit. Extending diametrically to but positioned above the bore 166 is a pivot pin bore 168. Corresponding bores are 170 and 172, formed through the sides of the rectangular recess 158. A pivot pin 174 extends through the bores 170, 172, and 168 to pivotally mount the rocker switch member 162 and thus the switch arm 152 in a manner similar to the pivotal mounting of the switch arm 46 of the first embodiment. The upper surfaces of the switch arms 162*a* and 162*b* are oriented relative to each other so that one is relatively coplanar with the upper surface of the rocker switch holder 150 when the switch arm is in an OFF position, and the other is relatively coplanar with the upper surface of the rocker switch holder 150 when the switch arm is in an ON position as shown in phantom outline in FIG. 9.

Still referring to FIGS. 8, 9, and 10, a second rectangular recess 180 is formed longitudinally spaced from the first rectangular recess 158. The second recess opens upwardly onto the upper surface of the rocker switch holder 150. The second recess houses an indicator lamp such as LED 182. An appropriate lens 184 can be positioned on a recess shoulder 186 at the top of the recess 180 and conventionally secured to the holder. Vertical slots 188 and 190 are provided in the sides of the switch holder 150 at a location below the main portion of the rectangular recess 180. The sots 188 extend to the bottom of the rocker switch holder. The upper portions of the slots 188 and 190 communicate via apertures 192 and 194, respectively with the bottom portion of the rectangulr recess 180. L-shaped contact arms 196 and 198 have one arm of each thereof positioned respectively in the slots 188 and 190 while the other arms extend through the apertures 192 and 194 into the recess 180. The LED 182, or other suitable light source, can be suitably electrically connected to the contact arms 196 and 198 as desired. The LED or other light source can thus be coupled into the circuit as desired by making appropriate electrical connections to the bottom ends of the contact arms 196 and 198.

The present invention has been described in relation to two embodiments. One of ordinary skill will be able to effect various alterations, substitutions of equivalents, and other changes to the disclosed embodiments without departing from the broad concepts disclosed herein. It is therefore intended that the scope of protection granted by Letters Patent hereon be limited only by the definition contained in the appended claims and equivalents thereof.

The embodiments of the invention in which an exclusive property or privilege is claimed are defined as follows:

1. A combination cartridge fuse holder and switch comprising:

a first contact bar and a second contact bar having upper edges, and having first ends, a first terminal and a second terminal, body means defining a cartridge fuse receptacle and a pair of contact bar receiving means, said contact bar receiving means being spaced and constructed to receive said first and second contact bars so that the upper edges are spaced from each other and so that the upper edges lie substantially in a contact plane, said body means further defining a ramp inclined relative to said contact plane and intersecting said contact plane adjacent the first ends of said contact bars, said first and second terminals being mounted on said body means, first connecting means for placing said first contact bar in electrical connection with said first terminal, second connecting means for placing said second contact bar in electrical connection with one end of said fuse receptacle so that when a cartridge fuse is positioned in said receptacle, one end of said fuse is in electrical contact with said second contact bar, third connecting means for placing said second terminal in electrical connection with the other end of said fuse receptacle so that when a cartridge fuse is positioned in said receptacle, the other end of said fuse is in electrical contact with said second terminal, and a contact pin, and holder means associated with the body means for moving said contact pin from said ramp on and off the upper edges of said contact bars to make and break contact between said first and second terminals when a cartridge fuse is positioned in said fuse receptacle.

2. The combination of claim 1 wherein said contact plane and said ramp are divergent from the point of intersection thereof away from said contact pin.

3. The combination of claim 1 or claim 2 further comprising biasing means associated with said contact pin and said holder means said biasing means for biasing said pin into contact with the upper surface of said ramp and with the upper edges of said contact bars.

4. The combination of claim 1 or 2 wherein said body means has a recess located in said ramp adjacent the first end of each of said contact bars.

5. The combination of claim 1 wherein said contact bars each have a second end, said contact bars having a transverse member integrally joined thereto at said second end, said transverse member having a forwardly facing edge adjacent said upper edges of said contact bars, said contact pin when residing on the upper edges of said contact bars adjacent said second end being in electrical contact with both said upper edges and said forwardly facing edges.

6. The combination of claim 1 wherein said body means has an upper surface, the upper surface of said body means adjacent the upper edges of said contact bars being recessed below said upper edges.

7. The combination of claim 1 wherein said contact pin is circular in cross section, and wherein said holder means mounts said pin for rotational movement, thereby allowing said pin to roll on said ramp and the upper edges of said contact bars.

8. The combination of claim 1 wherein said holder means for said contact pin comprises a switch holder and means for connecting said switch holder to said switch body, a switch arm mounted for swinging movement in said switch holder, the first end of said arm being mounted for swinging movement adjacent said ramp and the upper edges of said contact bars, said body means having a slot therein positioned between said contact bars and extending into said ramp so that the first end of said switch arm can extend into said body means, said contact pin being mounted adjacent the first end of said switch arm, the second end of said switch arm being connected to a manipulable member for swinging said switch arm from a first position wherein said contact pin is located on said ramp and a second position wherein said contact pin is bridging the upper edges of said contact bars.

9. The combination of claim 8 wherein said switch arm has a slot descending diametrally therethrough and extending longitudinally therealong adjacent the first end of said switch arm, said contact pin being mounted for rolling and longitudinal movement in said slot, said switch arm including a compression spring mounted in said slot for biasing said contact pin toward said ramp and the upper edges of said contact bars.

10. The combination of claim 1 wherein said body means has an upper portion and a lower portion, said contact bars and said ramp being located on the upper portion of said body means, said fuse receptacle being located on the bottom portion of said body means, said fuse receptacle including detent portions for receiving and holding the contact ferrules of a cartridge fuse.

11. The combination of claim 8 wherein said switch holder has an upper, substantially planar surface, said planar surface having a cylindrical projection extending upwardly therefrom, the second end of said switch arm extending through said cylindrical projection, said cylindrical projection being threaded to receive a retaining nut for fastening said combination switch and fuse holder to a panel.

12. The combination of claim 8 wherein said switch holder has an upper surface said switch holder being rectangular in cross section, the cross section of said body means being no larger than the cross section of said switch holder, said switch holder having a shoulder adjacent the upper surface thereof, said shoulder having a rectangular configuration and having a lower surface adapted to be positioned against the front face of a panel in which said switch is mounted.

13. The combination of claim 8 or claim 12 further comprising an indicator light associated with said switch holder.

14. The combination of claim 12 wherein said manipulable member comprises a rocker member having upwardly facing surfaces that converge downwardly toward the first end of said switch arm thereby forming a manipulable member having a rocker switch action.

* * * * *

UNITED STATES PATENT AND TRADEMARK OFFICE

CERTIFICATE OF CORRECTION

PATENT NO. : 4,298,854

DATED : November 3, 1981

INVENTOR(S) : James H. Andersen

It is certified that error appears in the above-identified patent and that said Letters Patent are hereby corrected as shown below:

| | | |
|---|---|---|
| Column 1, | Line 6 | "fuser" should be --fuse-- |
| Column 1, | Line 34 | "therfore" should be --therefore-- |
| Column 2, | Line 43 | "nd" should be --and-- |
| Column 3, | Line 3 | "that" should be --than-- |
| Column 6, | Line 62 | "in" should be --pin-- |
| Column 8, | Line 7 | "sots" should be --slots-- |

Signed and Sealed this

*Twenty-third* Day of *March 1982*

[SEAL]

*Attest:*

GERALD J. MOSSINGHOFF

*Attesting Officer*

*Commissioner of Patents and Trademarks*